US005445188A

United States Patent [19]

Bourkel et al.

[11] Patent Number: 5,445,188

[45] Date of Patent: Aug. 29, 1995

[54] PILOT OPERATED SERVO VALVE

[75] Inventors: Arsène Bourkel, Belvaux, Luxembourg; Bernd Lanfermann, Rees, Germany; Karl Tratberger, Duisburg, Germany; Karl H. Post, Kaarst, Germany

[73] Assignee: Hydrolux S.a.r.l., Luxembourg

[21] Appl. No.: 248,146

[22] Filed: May 24, 1994

[30] Foreign Application Priority Data

May 27, 1993 [LU] Luxembourg ..... 88277

[51] Int. Cl.[6] ..... F15B 13/043

[52] U.S. Cl. ..... 137/625.64; 137/625.63; 137/625.68

[58] Field of Search ..... 137/625.6, 625.64, 625.63, 137/625.68

[56] References Cited

U.S. PATENT DOCUMENTS 3,010,438 11/1961 Fife et al. .
3,215,163 11/1965 Henderson ..... 137/625.68
3,234,968 2/1966 Frantz ..... 137/625.63
3,722,547 3/1973 Kirstein .
4,827,981 5/1989 Livecchi et al. ..... 137/625.69
4,938,118 7/1990 Wolfges et al. ..... 137/625.64 X
5,144,983 9/1992 Schwelm ..... 137/625.64

FOREIGN PATENT DOCUMENTS 3532237 3/1987 Germany .

*Primary Examiner*—Gerald A. Michalsky
*Attorney, Agent, or Firm*—Howrey & Simon; C. Scott Talbot

[57] ABSTRACT

A pilot-operated servo valve design for efficient mounting in a control block has at least three main-stream ports. An opening into a control sleeve for a first main-stream port is disposed opposite an end surface of a main control piston. The main control piston has a pressure-equalizing surface disposed in a pressure-equalizing chamber, which is fluidically coupled by a pressure-equalizing duct in the main control piston to the first main-stream port. A return spring urges the main control piston toward a first axial end stop to clearly define a safety position. The valve exhibits good dynamic properties.

24 Claims, 6 Drawing Sheets

PILOT OPERATED SERVO VALVE

BACKGROUND OF THE INVENTION

The invention generally relates to hydraulic servo valves and specifically to a pilot-operated servo valve with at least three main-stream ports for mounting into a control block.

Pilot-operated electrohydraulic servo valves of twin- and multi-stage design with more than two main-stream ports are used, e.g. as four-way valves to control the position, speed, and/or force in hydraulic cylinders for linear movement, or position, rotation speed and/or torque in hydraulic motors for rotary movement. In either case the hydraulic device has two displacement chambers, each chamber being coupled to one of the main-stream ports.

These four-way servo valves are conventionally designed as plate-stack valves. A main control valve for the main stage is fitted either directly into a valve housing or into a control sleeve which in turn is inserted into the housing. The openings of the main-stream ports are typically arranged symmetrically relative to the likewise symmetrical main control piston. The main control piston is hydraulically actuated by applying hydraulic pressure to its two end surfaces, one in each of two control chambers defined by end caps flange-mounted onto opposite sides of the valve housing. The control chambers are connected via control bores to a pilot servo valve. Return springs bias the main control piston to a centered position.

There are various known designs for mounting valves in control blocks. For example, there are block mounted servo valves with high flow rates, but these valves have only two main-stream ports and are designed as seat valves. Screw-in block mounted valves with four main-stream ports are also known, but are designed as directional switching control valves and employ direct magnetic actuation.

An issue of particular importance to the practical use of servo valves is that of safety in the event of breakdown or fault in the electrical drive system or in the pilot servo valve. Such faults must not result in an undefined position of the main control piston and thus in uncontrollable movements of the hydraulic device, such as closing movements in presses.

Known multi-stage servo valves of the plate-stack design are constructed with an additional, electrically-actuated directional control or clearance valve disposed between the pilot servo valve and the hydraulic control chambers of the main control piston. In the event of a fault, this directional control valve reverts to a spring-biased, center position, in which the connection to the pilot servo valve is interrupted and the control chambers of the main control piston are fluidically coupled. The main control piston is thus biased by two compression springs to a centered position between two spring plates abutting the housing. To achieve well defined behavior of the cylinder movement when the main control piston is centered, the valve control edges must use positive overlapping (that is, the axial distance between the control edges assigned to a port is greater than the port's axial extent), at least in the direction of the pressure source. As compared to designs using zero-overlapping (that is, the axial distance between the control edges is equal to the port's axial dimension) of the four control edges between pressure source, working ports and tank return circuit, such control edge positive overlap has serious drawbacks as to the positioning accuracy of the cylinder in position-control devices and when the valve is used for pressure regulation.

There is therefore a need for a pilot-operated servo valve that can be effectively block mounted and that has a clearly-defined safety position without sacrificing the good dynamic properties available with zero-overlapping control edges. In particular, there is a need to provide these properties in a servo valve of the construction described above, i.e., with a control piston slidably mounted in a control sleeve that has axially spaced openings for at least three main stream ports, the piston having first and second control edges controlling flow through hydraulic connections between the first and second, and second and third main-stream ports, respectively, and in which the piston's movement is controlled by a pilot valve that selectively supplies pressurized fluid to at least one of two control chambers that act on opposing first and second actuating surfaces of the piston, the pilot valve in turn being in a control loop that takes input from a position transducer coupled to the piston.

SUMMARY OF THE INVENTION

These needs are met by the servo valve of the invention, which can be integrated in a space-saving manner into a control block, has a clearly defined safety position, and has good dynamic properties.

The opening into the control sleeve for the first main-stream port is disposed opposite a first end of the main control piston, while the openings for the other main-stream ports are disposed to the side of the main control piston. The main control piston incorporates a stop surface, which, by interaction with a corresponding counter-stop surface, mechanically defines a safety end position of the main control piston. A return spring urges the main control piston towards this end position.

The servo valve preferably includes a pressure-equalizing chamber fluidically coupled by a pressure-equalizing duct in the main control piston to the first main-stream port and in which a pressure-equalizing surface on the main control piston is disposed to hydrostatically oppose the first piston end-surface.

The servo valve's control sleeve is inserted directly into a stepped bore in the control block. The control block has lateral block bores for the second, third and additional main-stream ports. However, the design affords great flexibility for arrangement of the block bore for the first main-stream port. The block bore for the first main-stream port can be disposed, for example, in direct axial extension of the stepped bore for the control sleeve, which has not previously been possible in the case of traditional pilot-operated servo valves with more than two main ports. The need for bridgings in the control block between individual openings into the control sleeve is also eliminated. This design affords a more compact construction of the control block than is possible with traditional servo valves. Even in more complex hydraulic control systems, the servo valve according to the invention, together with various additional valves, for example two-way built-in valves, can be integrated in a space-saving manner into a control block. Direct mounting in the cylinder cover of larger cylinders is likewise possible.

A safety position of the servo valve is clearly, mechanically defined in the first axial end position of the main control piston by the direct butting contact of the main control piston against the sleeve, with the return spring urging the main control piston directly towards this position. Even where there is zero-overlapping of the control edges, the behavior of the valve in this safety position is clearly defined, which is not possible in the case of traditional, middle-centered servo valves.

The asymmetrical hydrostatic loading of the main control piston is compensated for by corresponding dimensioning of a pressure-equalizing surface. This hydrostatic compensation reduces the required main control piston actuating forces, allowing the actuating surfaces in the control chambers to be smaller. This results in smaller control-oil volumes, which means that shorter correction times are obtained for a given size pilot valve.

The valve according to the invention is preferably a four-way valve, with a fourth main-stream port opening in the control sleeve, an auxiliary connecting chamber connected via a cross-bore of the main control piston to the pressure-equalizing duct of the main control piston, third and fourth control edges on the piston controlling flow through hydraulic connections between the third and fourth main-stream port openings and between the auxiliary connecting chamber and the fourth main-stream port opening. This design does not require bridgings in the control block.

In a preferred embodiment, the second end of the main control piston is introduced, axially sealed, into the pressure-equalizing chamber to present a pressure-equalizing surface on the second end of the piston. This allows a more compact valve structure than is possible with an annular pressure-equalizing surface (although the latter embodiment is not precluded).

A hydrostatic over-compensation of the servo valve may be achieved by sizing the pressure-equalizing surface to have a greater axial area than that of the first piston end-side. Whenever the first main-stream port is pressurized, a correcting force therefore acts to urge the main control piston towards the first main-stream port and supplements the biasing force of the return spring.

Preferably, the first main-stream port is coupled to a pump and thus forms a pump port, the second main-stream port is coupled to a first displacement chamber of an energy-consuming unit and thus forms a first working port, the third main-stream port is coupled to a tank and thus forms a tank port, and the fourth main-stream port, where present, is coupled to a second displacement chamber of an energy-consuming unit and thus forms a second working port. In this design, the pump port can be introduced axially into the control sleeve, and the tank port can be located between the first and second working ports. However, other assignments of the main-stream ports are also possible.

As referred to herein, a "pump" is a hydraulic pressure source or line, a "tank" is a vessel or a line without significant counter-pressure, and an "energy-consuming unit" is for example a hydraulic rotary or linear drive system.

The control edges of the main control piston preferably exhibit a zero-overlapping. This gives excellent positioning accuracy, where the valve is used in a position-control circuit of a hydraulic cylinder, and excellent dynamic behavior, where the valve is used for pressure-regulating purposes. Since the valve is not middle-centered in its safety position, but has an axial end position, the zero-overlapping of the control edges has no adverse effect on the behavior of the valve in its safety position.

In one embodiment, the control edges are disposed so that when the main control piston is in its safety position, the first working port is connected to the tank port, while the second working port is connected via the pressure chamber to the pump port.

In another embodiment, the control edges are disposed so that when the main control piston is in its safety position, the second working port is shut off from the pump port and is coupled to the tank port.

In another embodiment, the control edges are disposed so that when the main control piston is in its safety position, the first and second working ports are shut off from both the pump port and the tank port.

In a further embodiment, a clearing valve is connected between the pilot valve and the main stage. When the clearing valve is relieved into a spring-biased basic position, for example in the event of an emergency shut-down signal or fault signal, the main control piston is urged by its return spring, and preferably by additional hydraulic pressure forces, into its safety end position.

With the above-described piston geometry, a hydraulic cylinder can thus, for example, either be stopped by shutting off the working ports or depressurized by connecting the working ports to the tank. This prevents uncontrolled travel of the cylinder to an end position when the control electronics fail in the machine control system or even in the pilot valve itself.

In another embodiment, the servo valve can be pilot controlled by a simple three-way pilot valve. This is accomplished by directly coupling the second control chamber (which contains the second piston actuating surface, oriented to urge the piston toward the safety end position) to a constantly unpressurized tank line. The first control chamber (which contains the first actuating surface oriented to urge the piston away from the safety end position) is coupled to the working port of the pilot valve.

In one embodiment, the position transducer of the main control piston is a path-measuring system with an electrical output and is integrated with the pilot valve into a closed control loop. In another embodiment, the servo valve has a mechanical feedback loop, using a three-way pilot slide valve extending axially from the second end of the main control piston. This pilot slide valve has a pilot pressure port, a pilot tank port, a pilot working port, and a slide piston. A measuring spring connects the slide piston axially to the main control piston and an actuating magnet, acting proportionally to an electric signal, is connected mechanically to the slide piston. The positioning of the main control piston is thus effected in a closed position-control circuit until force equilibrium between the magnetic force and the measuring-spring force is achieved.

With an additional clearing valve connected in the pilot-control system, additional cut-out safety can also be achieved with a three-way pilot valve. The pilot pressure port is in this case directly coupled via the clearing valve to the pilot tank port, and the pilot working port is coupled either to the pilot tank port or to the pilot pump port, depending on the slide piston's position. When the clearing valve is relieved, the main control piston travels, as described above, into its first axial end position.

DETAILED DESCRIPTION

Figure 1:
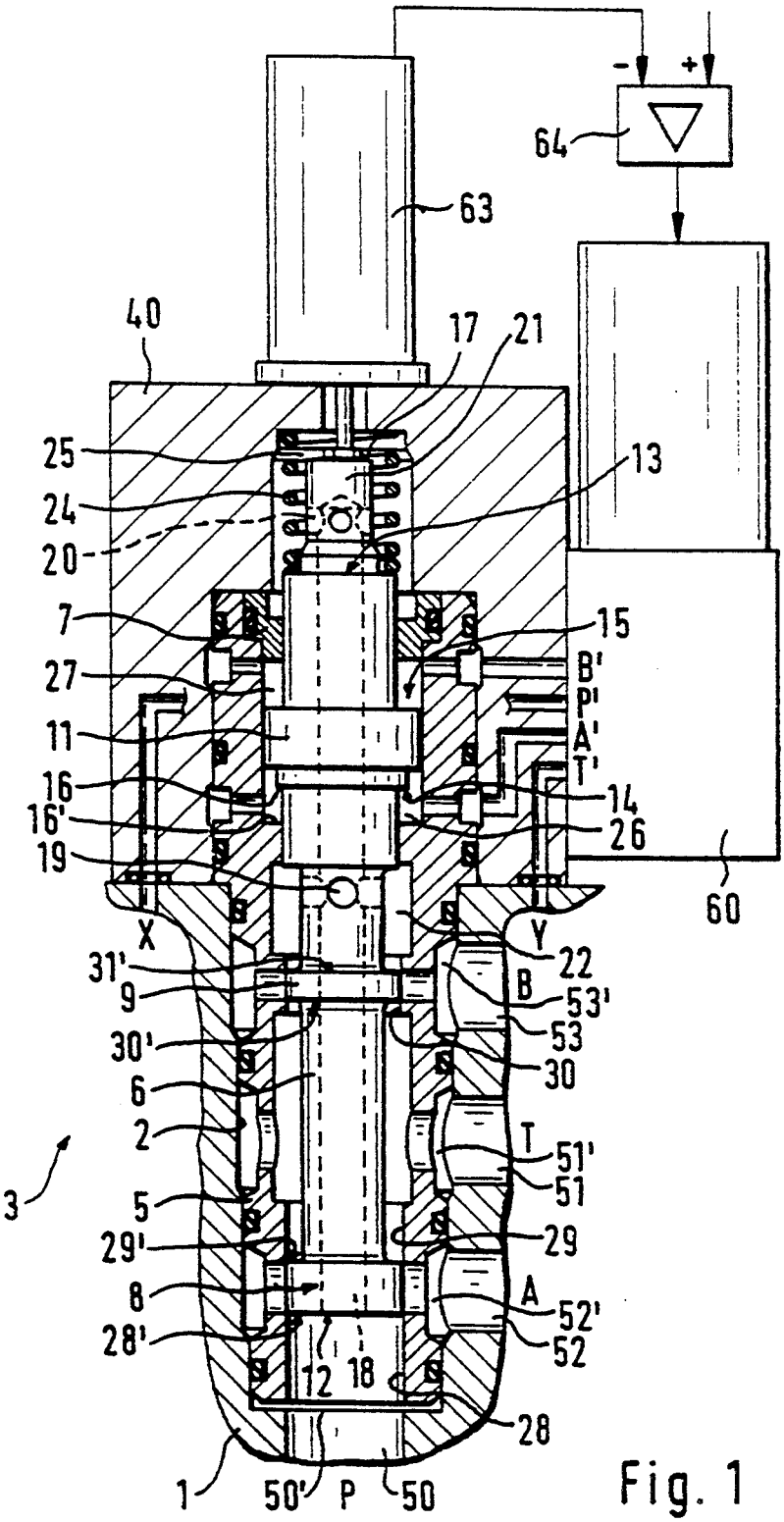
FIG. 1 presents a longitudinal sectional view of a first embodiment of a servo valve constructed in accordance with the principles of the present invention, the servo valve having a four-way pilot valve.

FIG. 1 presents a longitudinal sectional view through a first embodiment of a servo valve 3 embodying the principles of the present invention. A control sleeve 5 is mounted in a stepped bore 2 of a control block 1. A main control piston 6 is mounted in control sleeve 5 for sliding axial movement. The illustrated servo valve 3 is a four-way servo valve, having a pump port P, a tank port T, and first and second working ports A, B. Pump port P is fluidically coupled to a pressure line (i.e., a source of pressurized hydraulic fluid, not shown). Tank port T is fluidically coupled to an unpressurized line (not shown). Working ports A and B are fluidically coupled to first and second displacement chambers, respectively, of an energy-consuming unit (e.g., a hydraulic linear or rotary drive system) (not shown).

A first control block bore 50 for pump port P opens, as a coaxial extension of step bore 2, into pump port opening 50′ of control sleeve 5. Three block bores 51, 52, 53 in control block 1 for tank port T, first working port A, and second working port B, respectively, are disposed transversely to step bore 2 and open out laterally into axially spaced, annular channels 51′, 52′, 53′ in the outside surface of control sleeve 5, which in turn communicate with the interior of control sleeve 5 via circumferentially spaced openings therethrough. For purposes of description herein each annular channel and its corresponding circumferentially spaced openings are collectively referred to as a tank port or working port "opening."

The stepped internal surface of control sleeve 5 can be considered to define, in addition to the port openings, a series of chambers and axial hydraulic passages or connections between the chambers and the port openings. For example, portion 28 of the internal surface of control sleeve 5 between pump port opening 50′ and first working port opening 52′ is considered to be a first hydraulic connection that connects the two openings. Similarly, a second hydraulic connection 29 connects tank port opening 51′ to first working port opening 52′, a third hydraulic connection 30 connects tank port opening 51′ to second working port opening 53′, and a fourth hydraulic connection 31 connects second working port opening 53′ to an auxiliary connecting chamber 22 disposed coaxially within the control sleeve 5. The axial distance between second and third hydraulic connections 29 and 30 is much greater than the axial distances between first and second hydraulic connections 28 and 29 or between third and fourth hydraulic connections 30 and 31.

Main control piston 6 has a first coaxial piston collar 8, which is assigned to working port A and is displaceable axially into first and second hydraulic connections 28 and 29, and a second coaxial piston collar 9, which is assigned to working port B and is displaceable axially into third and fourth hydraulic connections 30 and 31. First piston collar 8 has a first control edge 28′ that is assigned to (controls flow through) first hydraulic connection 28, and a second control edge 29′ that is assigned to second hydraulic connection 29. Second piston collar 9 has a third control edge 30′ that is assigned to third hydraulic connection 30 and a fourth control edge 31′ that is assigned to fourth hydraulic connection 31. All four control edges 28′, 29′, 30′, 31′ have zero-overlapping.

Main control piston 6 has an axial end surface 12 that is disposed opposite pump port P and is therefore always acted on by the supply hydraulic pressure. An axial piston bore 18 extends from piston end surface 12, through the piston body to piston cross-bores 19, disposed above (in FIG. 1) second piston collar 9. Piston cross-bores 19 open into auxiliary connecting chamber 22 formed in control sleeve 5. Thus, auxiliary connecting chamber 22 is constantly fluidically coupled to pump port P and therefore operates at the supply hydraulic pressure. Accordingly, main control piston 6 selectively connects first working port A (with coaxial piston collar 8) and second working port B (with coaxial piston collar 9) to pump port P or tank port T. The respective flow rates of hydraulic fluid between the working ports and the pump or tank ports is regulated by the four control edges 28′, 29′, 30′, 31′.

The hydraulic pressure on piston end-surface 12 presents an asymmetrical axial hydrostatic load on main control piston 6. To equalize the hydrostatic forces on main control piston 6, the second, opposite end of main piston 6 is disposed in a pressure-equalizing chamber 25, which is disposed in a valve cap 40. Pressure-equalizing chamber 25 is maintained at the same hydraulic pressure as supply port P by connecting them via coaxial piston bore 18, which extends to the second end of main control piston 6 and is fluidically coupled via piston cross-bores 20 with pressure-equalizing chamber 25. The second end of main control piston 6 extends into pressure-equalizing chamber 25, axially sealed by a sealing insert 7. The portion of main control piston 6 that extends into pressure-equalizing chamber 25 is referred to as pressure-equalizing protrusion 21. The cross-sectional area of pressure-equalizing protrusion 21 presents a pressure-equalizing surface (which is indicated in FIG. 1 by reference to annular shoulder 13) which hydrostatically opposes piston end-surface 12. Full hydrostatic pressure equalization is obtained if pressure-equalizing surface 13 is chosen to be equal in area to piston end-surface 12. Hydrostatic over-compensation is achieved if pressure-equalizing surface 13 is chosen to be greater in area than piston end-surface 12.

Axial movement of main control piston 6 is effected via coaxial actuating piston collar 11 by the imposition of appropriate hydraulic pressure on its annular first or second actuating surfaces 14, 15. Piston collar 11 divides the large internal diameter portion at the upper end of control sleeve 5 into first and second control chambers 26 and 27, within which hydraulic pressure acts on first and second actuating surfaces 14 and 15, respectively. Control chambers 26 and 27 are connected via pilot ports to working ports A' and B' of a flange-mounted, four-way pilot servo valve 60. The axial position of main control piston 6 is measured by electrical position transducer 63. The output of transducer 63 (i.e., the position of main control piston 6) is input into electronic control amplifier 64, which compares this actual position information to a desired value, and outputs a control signal to pilot servo valve 60, thus forming a closed electrohydraulic feedback loop.

The dimensions of actuating surfaces 14, 15 are selected so that the flow forces generated when the control edges 28', 30' or 29', 31', respectively, are overflowed are reliably overcome. For a given pilot servo valve 60, very short correction times for the positioning of the main control piston 6 can thus be achieved.

The range of axial movement of main control piston 6 is bounded by axially opposed first and second end positions, which are defined mechanically by an annular stop surface 16 on a shoulder formed on the portion of main control piston in control chamber 26 and by an end stop surface 17 at the second end of the main control piston, respectively. When first control chamber 26 is not pressurized, main control piston 6 is urged downwardly by a return spring 24, which is disposed, for example, in pressure-equalizing chamber 25, until stop surface 16 abuts against a counter-surface 16' formed in the internal surface of control sleeve 5. In the first end position, the piston is disposed so that first control edge 28' closes first hydraulic connection 28 while second control edge 29' opens second hydraulic connection 29, so that working port A is disconnected from pressure port P and connected to tank port T. Further, fourth control edge 31' opens fourth hydraulic connection 31 and closes the third hydraulic connection 30, so that working port B is connected (via auxiliary connecting chamber 22) to pump port P and is disconnected from tank port T. Therefore, in this position, working port A is depressurized while working port B is pressurized.

Figure 2B:
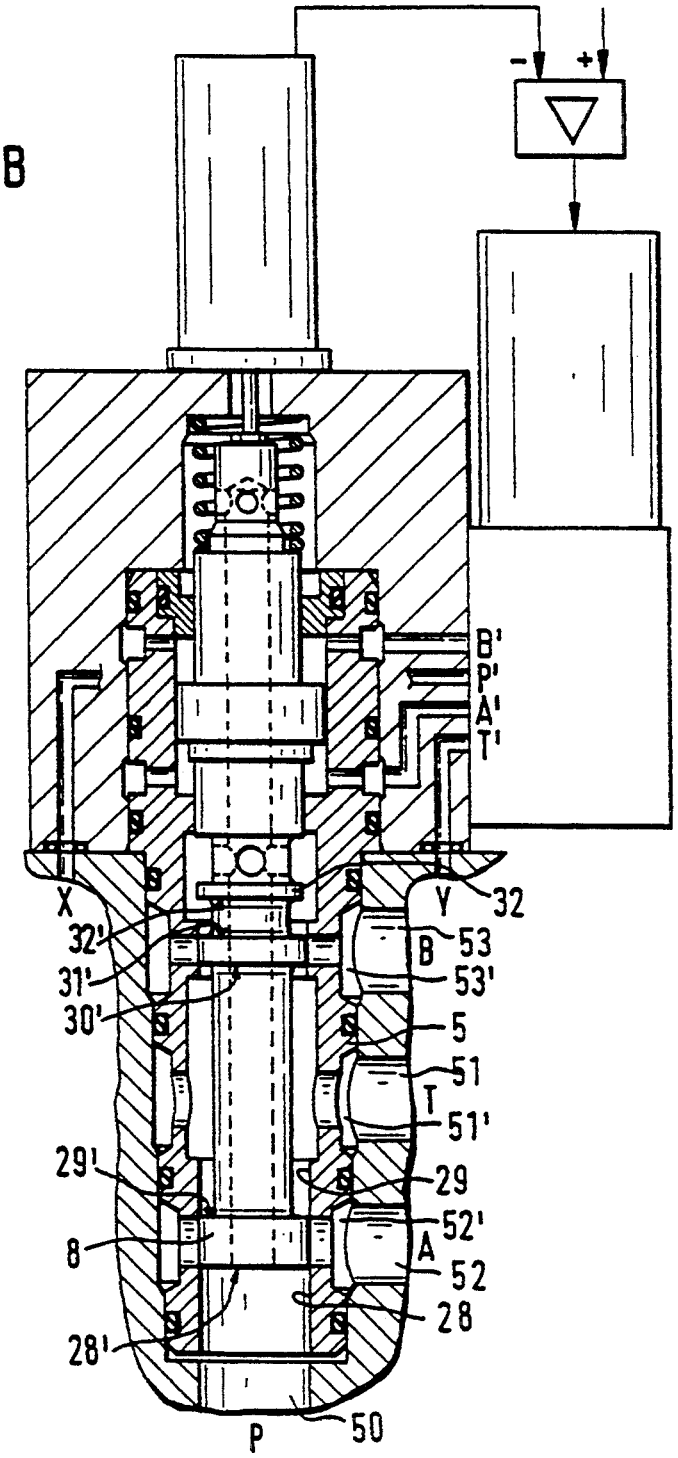
FIGS. 2A and 2B present two longitudinal sectional views of a second embodiment of a servo valve, also having a four-way pilot valve, showing the servo valve in two operating positions.
Figure 2A:
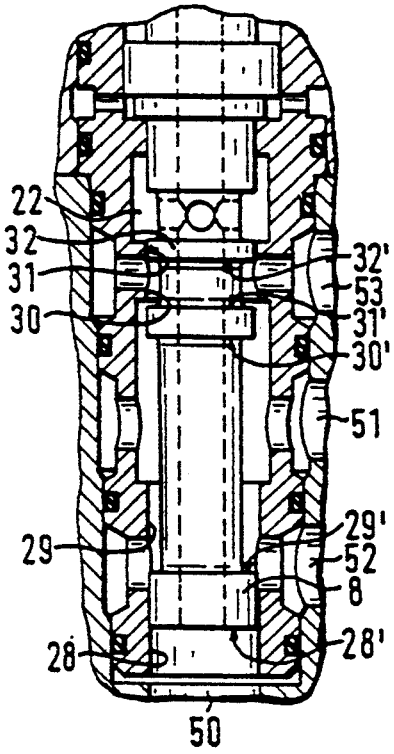

In many applications, such as presses and injection-molding machines, the cylinder controlled by the servo valve must operate fail-safe. That is, if a safety cut-out occurs or if the drive electronics fail or develop a fault, the controlled cylinder must not move. To achieve this result, both working ports A and B must either be depressurized (coupled to tank port T) or shut off. This has not previously been possible for servo valves with zero-overlapping control edges, but is achieved in the second embodiment of the present invention, illustrated in FIGS. 2A and 2B.

In the second valve embodiment, main control piston 6 has a first coaxial auxiliary piston collar 32, which has first auxiliary control edge 32'. When main control piston 6 is in its first end position, first auxiliary control edge 32' closes fourth hydraulic connection 31 (from auxiliary connecting chamber 22 to second working port B), while third and fourth control edges 30' and 31' (on second coaxial piston collar 9) simultaneously open third hydraulic connection 30 (between tank port T and working port B)—working port B is thus depressurized. First working port A is similarly depressurized since second control edge 29' (on first coaxial piston collar 8) opens second hydraulic connection 29. Both working ports, and therefore both working chambers in the energy-consuming unit, are depressurized.

Figure 3B:
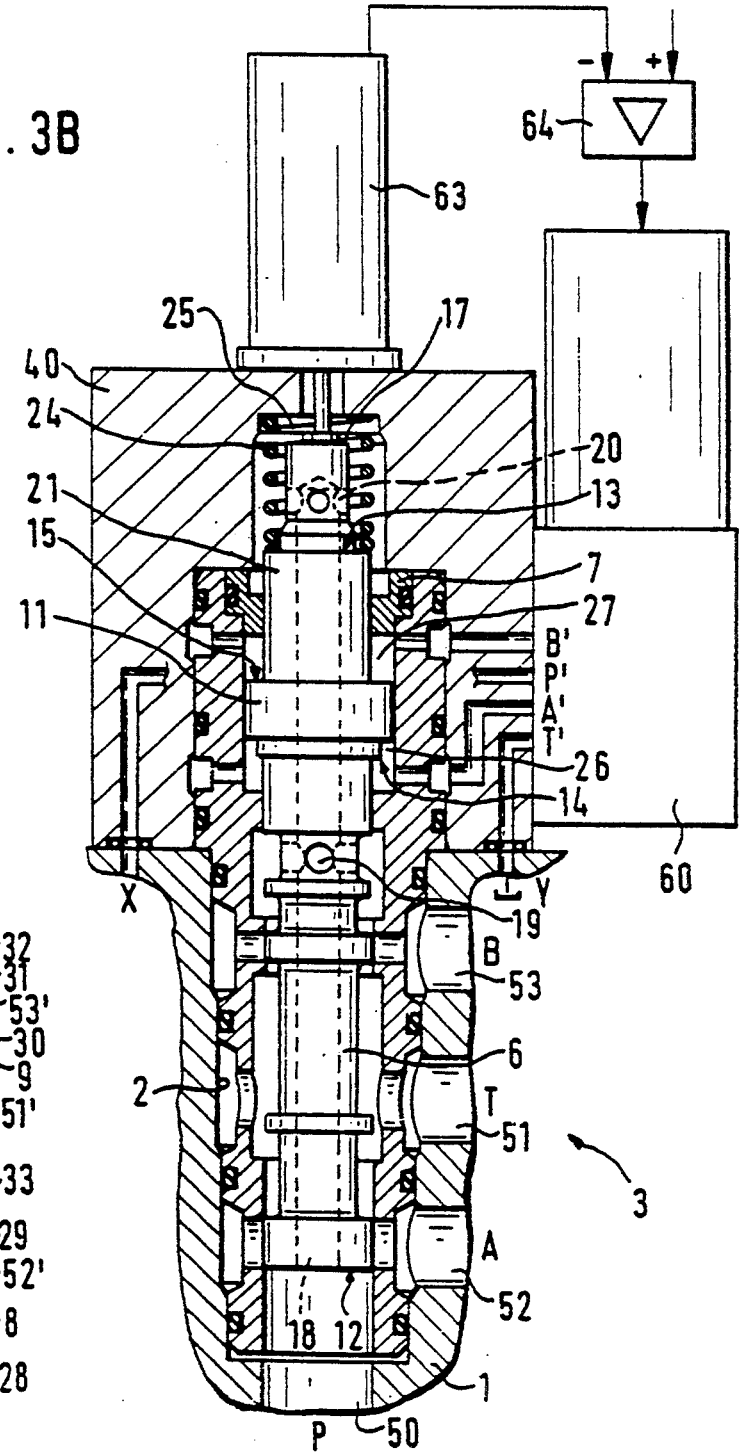
FIGS. 3A and 3B present two longitudinal sectional views of a third embodiment of a servo valve, also having a four-way pilot valve, showing the servo valve in two operating positions.
Figure 3A:
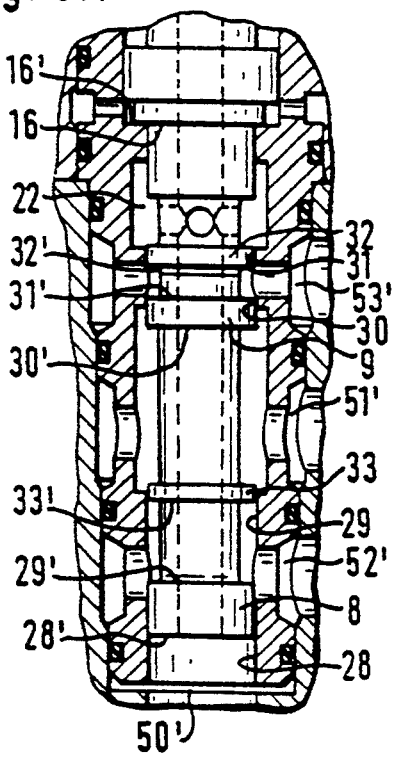

The alternative fail-safe mode (in which both working ports A and B are shut off when main control piston is in its first end position, thereby locking the driven cylinder in place even when external loads are imposed on it) is achieved by a third valve embodiment, illustrated in FIGS. 3A and 3B. In this embodiment, main control piston 6 has a second coaxial auxiliary piston collar 33, which has second auxiliary control edge 33'. Further, as compared to the second embodiment, first auxiliary control edge 32' is moved closer to fourth control edge 31'. Therefore, when main control piston 6 is in its first end position, first auxiliary control edge 32' closes (as in the second embodiment) fourth hydraulic connection 31 (between the auxiliary connecting chamber 22 and the working port B) and fourth control edge 31' closes third hydraulic connection 30 (between tank port T and working port B). Simultaneously, first control edge 28' closes first hydraulic connection 28 (between pump port P and working port A), and second auxiliary control edge 33' closes second hydraulic connection 29 (between tank port T and working port A). Thus, both working ports A and B are shut off, both to the tank side and to the pressure side.

Figure 4:
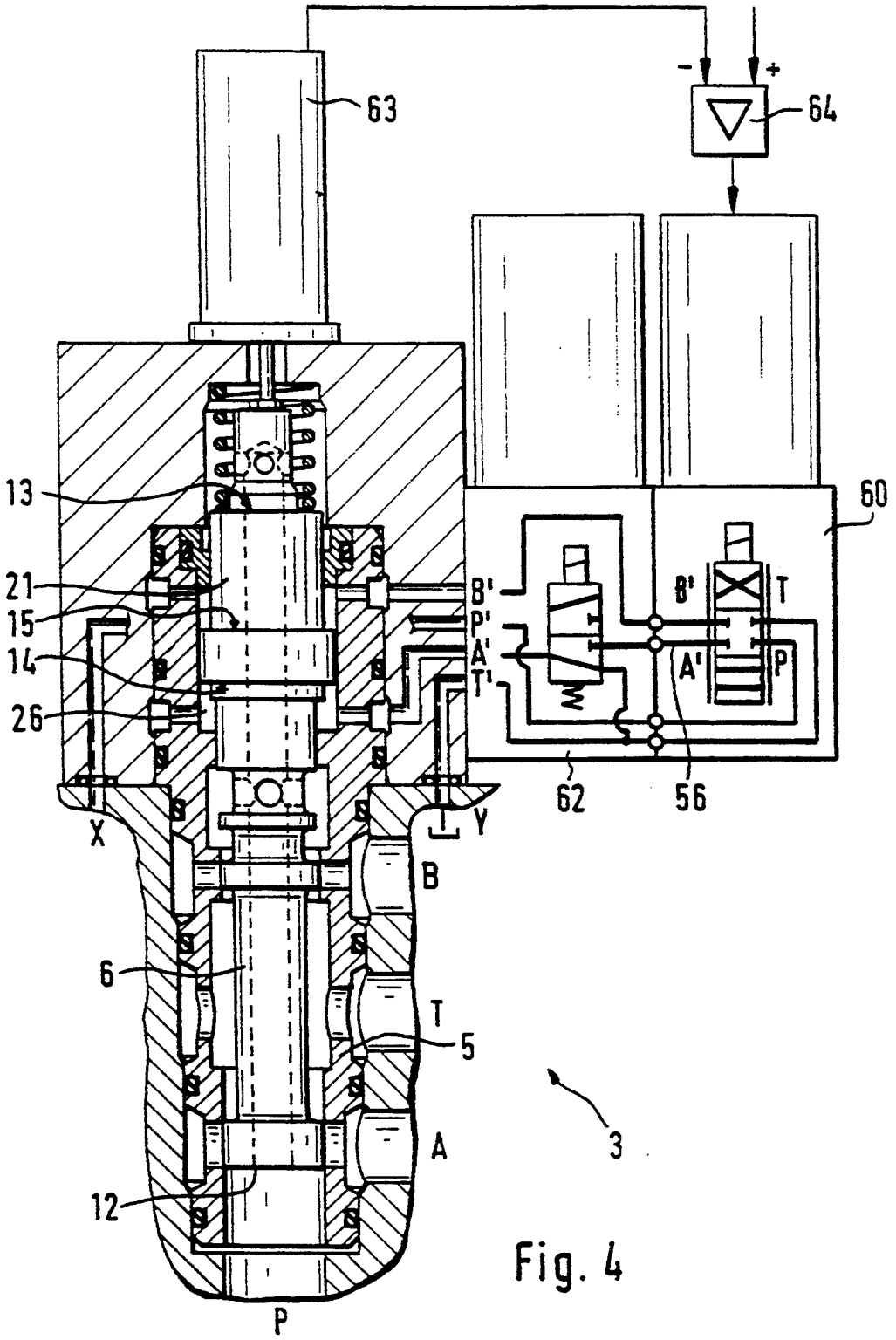
FIG. 4 presents a longitudinal sectional view of the servo valve of FIG. 1, with a clearing valve.

In a fourth valve embodiment illustrated in FIG. 4, main control piston 6 is configured to produce an over-compensating hydrostatic force on the piston that acts in concert with the bias force of return spring 24 to urge the piston toward its first end position. As shown in FIG. 4, this is achieved by increasing the diameter of pressure-equalizing protrusion 21, so that pressure-equalizing surface 13 is greater in area than piston end-surface 12.

A further feature illustrated in the fourth embodiment is a clearing valve 62, connected between four-way pilot servo valve 60 and first control chamber 26. The ports of pilot servo valve 60 are identified similarly to those of servo valve 3—its pilot pressure port (coupled to control pressure line X) is identified as P', its pilot tank port (coupled to unpressuized control line Y) is identified as T', its first pilot working port (coupled via line 56 and clearing valve 62 to first control chamber 26) is identified as A', and its second pilot working port (coupled to second control chamber 27) is identified as B'. When clearing valve 62 is in its spring-biased position (i.e. the solenoid is not energized), first control chamber 26 (which contains actuating surface 14) is depressurized (relieved in the direction of the tank). Therefore, regardless of the position of pilot servo valve 60, main control piston 6 is urged into its first end position. Pilot servo valve 60 only becomes effective for positioning main control piston 6 when clearing valve 62 is energized into its second position, in which second pilot working port B' is coupled to first control chamber 26.

Figure 5:
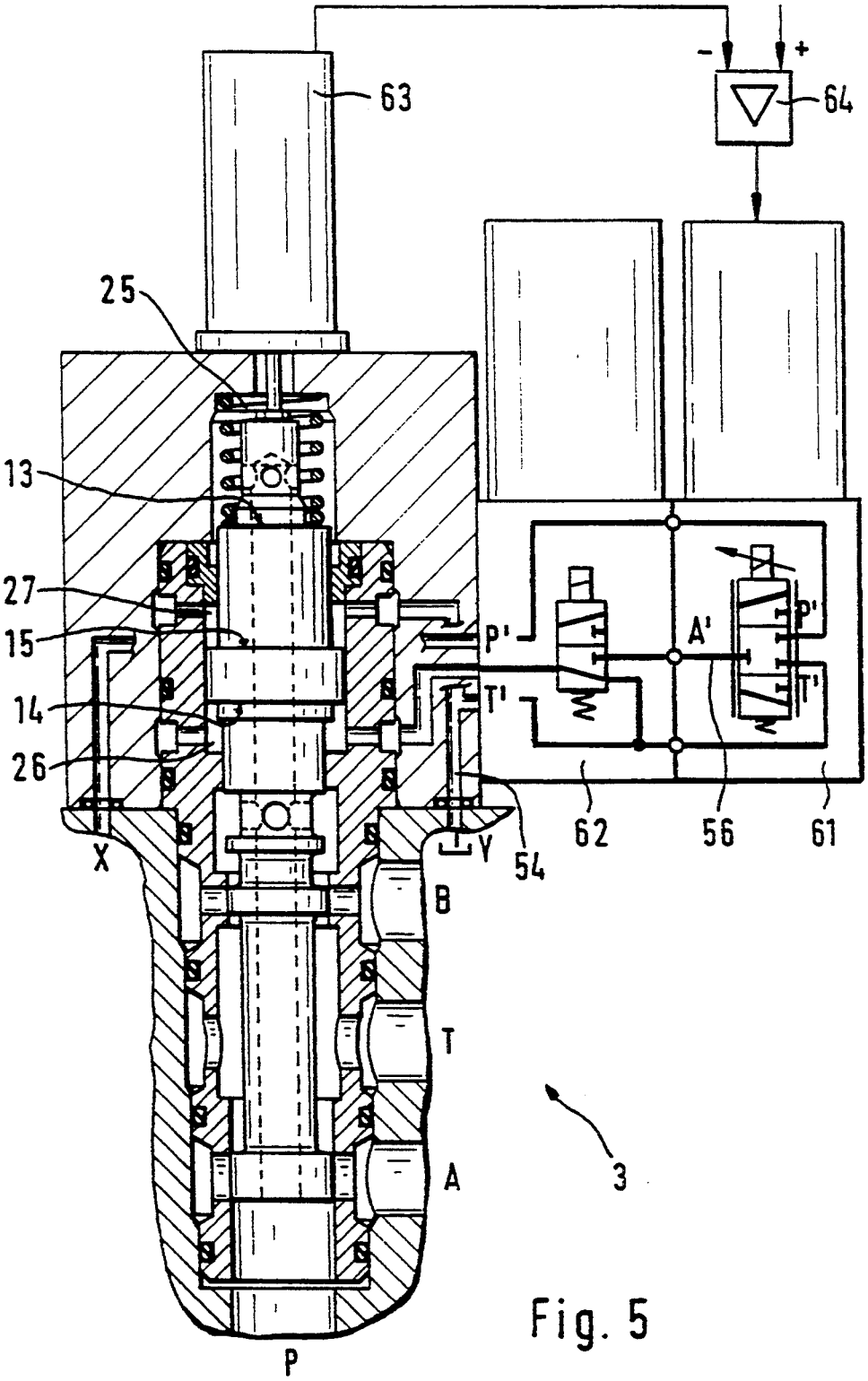
FIG. 5 presents a longitudinal sectional view of the servo valve of FIG. 1, with a clearing valve and a three-way pilot valve.

In accordance with a fifth embodiment of the invention, illustrated in FIG. 5, the cost of the fourth valve embodiment can be reduced by controlling the position of main control piston 6 with a simpler, three-way pilot valve 61. Pilot valve 61 has a pilot pump port P', a pilot tank port T', and a single pilot control port A'. Pilot pump port P' is pressurized via control pressure line X, while pilot tank port T' is connected to an unpressurized control line Y. Pilot control port A' coupled via clearing valve 62 to first control chamber 26.

Since, in this embodiment as in the fourth embodiment, pressure-equalizing protrusion has an increased diameter, second actuating surface 15 in second control chamber 27 is smaller than first actuating surface 14 in first control chamber 26. Second control chamber 27 is constantly relieved in the direction of the tank via line 54 and unpressurized control line Y. When pilot valve 61 has not been triggered, main control piston 6 is in the workrest position. When pilot valve 61 is electrically triggered (i.e., its solenoid is energized), a hydraulic control force is generated by pressurization of the larger, first actuating surface 14, controlling the position of main control piston 6, as described above, with the electrohydraulic position-control feedback loop. To achieve this positioning, however, clearing valve 62 must be energized. When clearing valve 62 is relieved into its basic position, e.g. as a result of a fault, control chamber 26 is again depressurized so that, regardless of the position of pilot valve 61, main control piston 6 is urged into its first end position by the hydrostatic over-compensation and by return spring 24.

If the additional safety feature of clearing valve 62 is not required, the valve can be omitted. Control chamber 26 is then connected directly to pilot control port A' of pilot valve 61.

Figure 6:
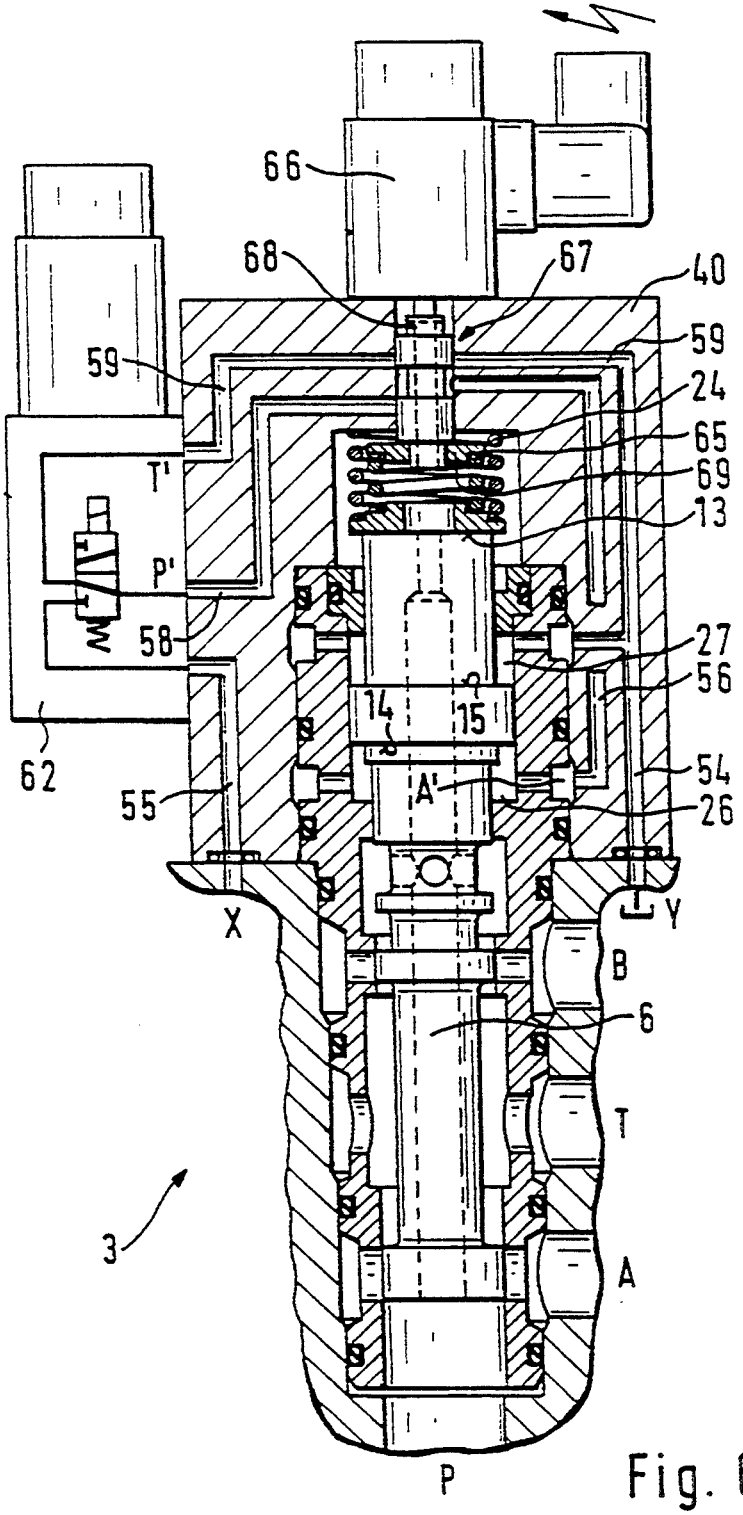
FIG. 6 presents a longitudinal sectional view of the servo valve of FIG. 1, with a clearing valve and an integrated three-way pilot valve having a mechanical feedback loop.

As an alternative to the electrical feedback loop illustrated in FIGS. 1 to 5 and described above, which uses the electrical position transducer 63 shown, a mechanical feedback loop may be used in accordance with a sixth embodiment, illustrated in FIG. 6. In this embodiment, a three-way piston slide valve 67 is disposed as an axial extension of main control piston 6. It has a pilot pump port P' (with associated line 58), a pilot tank port T' (with associated line 59), a pilot control port A' (with associated line 56) and a slide piston 68. Slide piston 68 is supported at one end on a spring plate 69 in pressure-equalizing chamber 25 and is connected at its second end to a proportional magnet 66. A measuring spring 65 is disposed in pressure-equalizing chamber 25 between spring plate 69 and main control piston 6. Slide piston 68 is axially bored through for hydrostatic pressure-equalization. Regardless of the position of slide piston 68, control port A' is constantly connected either to pilot pump port P' or to pilot tank port T'. Main control piston 6 has the same configuration as in the fourth and fifth embodiments, and thus has the same characteristics.

The force build-up of proportional magnet 66 is proportional to an electrical control current, i.e. the desired value. The spring force of measuring spring 65 is proportional to the position of main control piston 6, i.e. the actual value. The output control pressure of pilot slide valve 67, which is acting on first actuating surface 14, is corrected in the event of differences between the desired and actual value until the electrically pre-determined position in the position-control feedback loop is achieved.

A clearing valve 62 is coupled to pilot pump port P' (at one end of line 58'). When clearing valve 62 is electrically relieved into its basic position, pilot pump port P' is depressurized by coupling it to unpressurized control line Y (via lines 59, 54). Regardless of the position of pilot slide valve 67, actuating surface 14 is therefore always depressurized, so that main control piston 6 is urged by the hydrostatic over-compensation and return spring 24 into its first end position.

Again, if safety requirements are reduced, clearing valve 62 can be omitted without affecting the reliable basic functioning of servo valve 3.

What is claimed is:

1. A pilot operated servo valve comprising:

a control sleeve having:

first, second, and third main stream port openings therethrough, each of said main stream port openings corresponding to a respective main stream port and said openings being axially spaced;

a first hydraulic connection within said control sleeve between said first and second main stream port openings;

a second hydraulic connection within said control sleeve between said second and third main stream port openings;

first and second control chambers; and a counter-stop surface;

a pressure-equalizing chamber;

a main control piston disposed for axial displacement within said control sleeve, said main control piston having:

a first end having a first piston end surface formed thereon, said first main-stream port opening being disposed opposite said first piston end surface and said second and third main-stream port openings being disposed sideways from said main control piston;

a second end;

a first control edge disposed to control flow through said first hydraulic connection;

a second control edge disposed to control flow through said second hydraulic connection;

a first actuating surface disposed in said first control chamber;

a second actuating surface disposed in said second control chamber and axially opposing said first actuating surface;

a pressure-equalizing surface disposed in said pressure-equalizing chamber and axially opposing said first piston end surface;

a pressure-equalizing duct therethrough fluidically coupling said first main stream port opening to said pressure-equalizing chamber; and a stop surface disposed for selective engagement with said counter-stop surface, said piston being in a first axial end position when said stop and counter-stop are engaged;

a pilot valve fluidically coupled to at least one of said first and second control chambers;

a feedback loop between said main control piston and said pilot valve, said feedback loop including a position transducer measuring the axial position of said main control piston within said control sleeve; and a spring engaging said main control piston to bias said piston toward said first axial end position.

2. The pilot-operated servo valve of claim 1, further comprising:

a lateral, fourth main-stream port opening through said control sleeve corresponding to a fourth main-stream port;

an auxiliary connecting chamber;

a cross-bore in said main control piston fluidically coupling said pressure-equalizing duct to said auxiliary connecting chamber;

a third hydraulic connection within said control sleeve between said third and fourth main-stream port openings;

a fourth hydraulic connection within said control sleeve between said fourth main-stream port opening and said auxiliary connecting chamber;

a third control edge on said main control piston, said third control edge being disposed to control flow through said third hydraulic connection; and a fourth control edge on said main control piston, said fourth control edge being disposed to control flow through said fourth hydraulic connection.

3. The pilot-operated servo valve of claim 2, wherein said four control edges of said main control piston are zero-overlapping.

4. The pilot-operated servo valve of claim 3 wherein when said main control piston is in said first axial end position:

said first hydraulic connection is closed by one of said first and second control edges;

said second hydraulic connection is opened;

said third hydraulic connection is closed by one of said third and fourth control edges; and said fourth hydraulic connection is opened.

5. The pilot-operated servo valve of claim 2, further comprising first and second auxiliary control edges on said piston, and wherein when said main control piston is in said first axial end position:

said first and second control edges are disposed such that at least one of said first and second control edges closes said first hydraulic connection;

said third and fourth control edges are disposed such that at least one of said third and fourth control edges closes said third hydraulic connection;

said first auxiliary control edge closes said fourth hydraulic connection; and said second auxiliary control edge closes said second hydraulic connection.

6. The pilot-operated servo valve of claim 2, further comprising an auxiliary control edge on said piston, and wherein when said main control piston is in said first axial end position:

said first and second control edges are disposed such that at least one of said first and second control edges closes said first hydraulic connection;

said third and fourth control edges are disposed such that said third hydraulic connection is open;

said auxiliary control edge closes said fourth hydraulic connection.

7. The pilot-operated servo valve of claim 1, wherein said pressure-equalizing surface is formed on said second end, said second end being disposed in said pressure-equalizing chamber, said pressure-equalizing surface thereby hydrostatically opposing said first piston end-surface.

8. The pilot-operated servo valve of claim 7 wherein said second end has a greater diameter than does said first end.

9. The pilot-operated servo valve of claim 1 wherein said pressure-equalizing surface has a greater axially-acting area than does said first piston end-surface.

10. The pilot-operated servo valve of claim 1, wherein:

said first main-stream port is fluidically coupled to a source of pressurized hydraulic fluid, thereby constituting a pump port;

said second main-stream port is fluidically coupled to a first displacement chamber of an energy-consuming unit, thereby constituting a first working port; and said third main-stream port is fluidically coupled to an unpressurized tank, thereby constituting a tank port.

11. The pilot-operated servo valve of claim 10, further comprising a lateral, fourth main-stream port opening through said control sleeve corresponding to a fourth main-stream port, said fourth main-stream port being fluidically coupled to a second displacement chamber of said energy-consuming unit, thereby constituting a second working port.

12. The pilot-operated servo valve of claim 11, further comprising a clearing valve fluidically coupled between said first control chamber and said pilot valve, said clearing valve selectively fluidically coupling said first control chamber to an unpressurized control line, and wherein said first actuating surface is disposed to urge said main control piston away from said first axial end position.

13. The pilot-operated servo valve of claim 11, wherein:

said second control chamber is fluidically coupled to an unpressurized control line;

said second actuating surface is disposed to urge said main control piston towards said first axial end position;

said pilot valve is a three-way valve having a pilot control port;

said first control chamber is fluidically coupled to said pilot control port; and said first actuating surface is disposed to urge said main control piston away from said first axial end position.

14. The pilot-operated servo valve of claim 13, wherein said position transducer includes a path-measuring system with an electrical output, said path-measuring system forming with said pilot valve a closed control loop.

15. The pilot-operated servo valve of claim 13 wherein said pilot valve is a three-way pilot slide valve extending axially from said second end of said main control piston, said pilot valve having a pilot pressure port, a pilot tank port, a pilot working port, a slide piston, and a measuring spring coupling said slide piston axially to said main control piston, and further comprising an actuating magnet coupled to said slide piston and having a response proportional to an electric signal.

16. The pilot-operated servo valve of claim 15, further comprising a clearing valve selectively fluidically coupling said pilot pressure port to said pilot tank port and wherein said pilot slide valve is configured so that said pilot control port is fluidically coupled either to said pilot tank port or to said pilot pump port, depending upon the position of said slide piston.

17. A pilot operated servo valve comprising:

a control sleeve having:

first, second, third and fourth main stream port openings therethrough, each of said main stream port openings corresponding to a respective main stream port and said openings being axially spaced;

an auxiliary connecting chamber;

a first hydraulic connection between said first and second main stream port openings;

a second hydraulic connection between said second and third main stream port openings;

a third hydraulic connection between said third and fourth main stream port openings;

a fourth hydraulic connection between said fourth main stream port and said auxiliary connecting chamber, said first, second, third, and fourth hydraulic connections being disposed within said control sleeve;

first and second control chambers; and a counter-stop surface;

a main control piston disposed for axial displacement within said control sleeve, said main control piston having:

a first end having a first piston end surface formed thereon, said first main-stream port opening being disposed opposite said first piston end surface and said second, third, and fourth main-stream port openings being disposed sideways from said main control piston;

a second end;

a stop surface disposed for selective engagement with said counter-stop surface, said piston being in a first axial end position when said stop and counter-stop are engaged;

a first control edge disposed to control flow through said first hydraulic connection;

a second control edge disposed to control flow through said second hydraulic connection;

a third control edge disposed to control flow through said third hydraulic connection;

a fourth control edge disposed to control flow through said fourth hydraulic connection;

an auxiliary control edge disposed such that, when said main control piston is in said first axial end position, said auxiliary control edge closes at least one of said first, second, third, and fourth hydraulic connections;

a first actuating surface disposed in said first control chamber;

a second actuating surface disposed in said second control chamber and axially opposing said first actuating surface;

an axial pressure-equalizing duct and a lateral cross-bore therethrough fluidically coupling said first main stream port opening to said auxiliary connecting chamber; and a pilot valve fluidically coupled to at least one of said first and second control chambers;

a feedback loop between said main control piston and said pilot valve, said feedback loop including a position transducer indicating the axial position of said main control piston within said control sleeve; and a return spring engaging said main control piston to bias said piston toward said first axial end position.

18. The pilot-operated servo valve of claim 17, further comprising first and second auxiliary control edges on said piston, and wherein when said main control piston is in said first axial end position:

said first and second control edges are disposed such that at least one of said first and second control edges closes said first hydraulic connection;

said third and fourth control edges are disposed such that at least one of said third control edges closes said third hydraulic connection;

said first auxiliary control edge closes said fourth hydraulic connection; and said second auxiliary control edge closes said second hydraulic connection.

19. The pilot-operated servo valve of claim 17, wherein when said main control piston is in said first axial end position:

said first and second control edges are disposed such that at least one of said first and second control edges closes said first hydraulic connection;

said third and fourth control edges are disposed such that said third hydraulic connection is open;

said auxiliary control edge is disposed such that it closes said fourth hydraulic connection.

20. The pilot-operated servo valve of claim 17, further comprising a clearing valve having a fail-safe position, said clearing valve fluidically coupling said first control chamber to an unpressurized control line when it is in said fail-safe position, and wherein said first actuating surface is disposed in said first control chamber so as to urge said main control piston away from said first axial end position.

21. The pilot-operated servo valve of claim 17, wherein:

said second control chamber is fluidically coupled to an unpressurized control line;

said second actuating surface is disposed to urge said main control piston towards said first axial end position;

said pilot valve is a three-way valve having a pilot control port;

said first control chamber is fluidically coupled to said pilot control port; and said first actuating surface is disposed to urge said main control piston away from said first axial end position.

22. The pilot-operated servo valve of claim 21, wherein said position transducer includes a path-measuring system with an electrical output, said path-measuring system forming with said pilot valve a closed control loop.

23. The pilot-operated servo valve of claim 21, wherein said pilot valve is a three-way pilot slide valve extending axially from said second end of said main control piston, said pilot valve having a pilot pressure port, a pilot tank port, a pilot working port, a slide piston, and a measuring spring coupling said slide piston axially to said main control piston, and further comprising an actuating magnet coupled to said slide piston and having a response proportional to an electric signal.

24. The pilot-operated servo valve of claim 23, further comprising a clearing valve selectively fluidically coupling said pilot pressure port to said pilot tank port and wherein said pilot slide valve is configured so that said pilot control port is fluidically coupled either to said pilot tank port or to said pilot pump port, depending upon the position of said slide piston.

* * * * *